US010167607B2

(12) United States Patent
Pratt

(10) Patent No.: US 10,167,607 B2
(45) Date of Patent: Jan. 1, 2019

(54) DRAINAGE SYSTEM WITH CONTIGUOUS VOID

(71) Applicant: James M. Pratt, Needham, MA (US)

(72) Inventor: James M. Pratt, Needham, MA (US)

( * ) Notice: Subject to any disclaimer, the term of this patent is extended or adjusted under 35 U.S.C. 154(b) by 519 days.

(21) Appl. No.: 14/862,462

(22) Filed: Sep. 23, 2015

(65) Prior Publication Data

US 2017/0081823 A1 Mar. 23, 2017

(51) Int. Cl.

| | |
|---|---|
| ***E02D 31/02*** | (2006.01) |
| ***E04B 1/70*** | (2006.01) |
| ***E02D 19/10*** | (2006.01) |

(52) U.S. Cl.

CPC ..... *E02D 31/02* (2013.01); *E02D 19/10* (2013.01); *E04B 1/7023* (2013.01); *Y10T 137/6988* (2015.04); *Y10T 137/86067* (2015.04)

(58) Field of Classification Search

CPC ..... Y10T 137/86067; Y10T 137/6988; E02D 31/02; E02D 19/10; E04B 1/7023

See application file for complete search history.

(56) References Cited

U.S. PATENT DOCUMENTS

| | | | |
|---|---|---|---|
| 3,426,487 | A | 2/1969 | Forte |
| 4,185,429 | A | 1/1980 | Mendola |
| 4,235,008 | A | 11/1980 | Meredith |
| 4,245,443 | A | 1/1981 | Beechen |
| 4,333,281 | A | 6/1982 | Scarfone |
| 4,460,292 | A | 7/1984 | Durham et al. |
| 4,612,742 | A | 9/1986 | Bevilacqua |
| 4,745,716 | A | 5/1988 | Kuypers |
| 4,815,888 | A | 3/1989 | Stegmeier |
| 4,869,032 | A | 9/1989 | Geske |
| 5,046,529 | A | 9/1991 | Corella |
| 5,239,794 | A | 8/1993 | Klein |
| 5,288,268 | A | 2/1994 | Kuypers |
| 5,452,739 | A | 9/1995 | Mustee et al. |
| 5,454,663 | A | 10/1995 | Stegmeier |
| 5,501,044 | A | 3/1996 | Janesky |
| 5,529,436 | A | 6/1996 | Meyers |
| 5,729,937 | A | 3/1998 | Mantelli |
| 5,765,323 | A | 6/1998 | Bevilacqua |
| 5,771,643 | A | 6/1998 | Parker |
| 5,784,838 | A | 7/1998 | Phillips |

(Continued)

FOREIGN PATENT DOCUMENTS

| | | |
|---|---|---|
| JP | 10-219759 | 8/1998 |

*Primary Examiner* — Atif Chaudry

(74) *Attorney, Agent, or Firm* — Thomas P. O'Connell; O'Connell Law Firm

(57) ABSTRACT

A drainage system for engaging and removing accumulating drainage water with a sump pump liner, a sump pump disposed within the liner, and at least one contiguous void with an inner volume in fluidic communication with an inner volume of the liner. The void can comprise a low pressure void compartment disposed distal to the bottom of the liner, or the void can comprise a water harvesting arm with a proximal end retained by the main body of the liner and a body portion that projects from the main body. Liner-void apertures can be disposed in the bottom of the main body of the liner, and void-environment apertures can be disposed in a void bottom partition. The main body can have a rectangular cross section with a lateral water harvesting arm projecting from each sidewall.

16 Claims, 5 Drawing Sheets

(56) References Cited

U.S. PATENT DOCUMENTS

| | | | | |
|---|---|---|---|---|
| 5,815,544 | A * | 9/1998 | Lefter | B01D 29/15 376/313 |
| 5,881,762 | A | 3/1999 | Janesky | |
| 5,918,591 | A | 7/1999 | Vollmar et al. | |
| 6,052,959 | A | 4/2000 | LaBrosse | |
| 6,129,838 | A | 10/2000 | Millner | |
| 6,142,703 | A | 11/2000 | Wilmot et al. | |
| 6,202,366 | B1 | 3/2001 | Snyder et al. | |
| 6,230,468 | B1 | 5/2001 | Klaus | |
| 6,241,421 | B1 | 6/2001 | Harvie et al. | |
| 6,253,785 | B1 | 7/2001 | Shumake, Jr. et al. | |
| 6,598,360 | B1 | 7/2003 | Pratt | |
| 6,612,780 | B2 | 9/2003 | Dahowski et al. | |
| 6,619,001 | B1 | 9/2003 | Pratt | |
| 6,634,144 | B1 | 10/2003 | Moore et al. | |
| 6,672,016 | B2 | 1/2004 | Janesky | |
| 6,976,501 | B1 | 12/2005 | Pratt | |
| 7,066,685 | B2 | 6/2006 | Humphries et al. | |
| 7,080,662 | B1 | 7/2006 | Pratt | |
| 7,246,472 | B2 | 7/2007 | Nielsen | |
| 7,380,374 | B1 | 6/2008 | Pratt | |
| 7,503,725 | B1 | 3/2009 | Pratt et al. | |
| 7,588,392 | B2 | 9/2009 | Wroblewski et al. | |
| 7,637,694 | B1 | 12/2009 | Musser | |
| 7,748,170 | B1 | 7/2010 | Pratt | |
| 7,832,150 | B1 | 11/2010 | Pratt | |
| 7,836,640 | B1 | 11/2010 | Pratt | |
| 8,186,127 | B1 | 5/2012 | Pratt | |
| 2003/0131887 | A1 | 7/2003 | Gaynier | |
| 2004/0040598 | A1 | 3/2004 | Zimmerman et al. | |
| 2008/0190045 | A1 | 8/2008 | Janesky | |
| 2009/0183785 | A1* | 7/2009 | Cole | E03F 5/22 137/363 |
| 2011/0041426 | A1 | 2/2011 | Trotter | |
| 2011/0070027 | A1* | 3/2011 | Hurley | E02B 11/00 405/41 |
| 2015/0167267 | A1* | 6/2015 | Hyde | E03B 3/06 405/45 |

* cited by examiner

DRAINAGE SYSTEM WITH CONTIGUOUS VOID

FIELD OF THE INVENTION

The present invention relates generally to active pumping and drainage systems. More particularly, disclosed herein is an active pumping and drainage system with a sump pump liner having one or more contiguous voids in fluidic communication with a pumping mechanism for attracting accumulated drainage water and promoting the effective pumping and removal thereof.

BACKGROUND OF THE INVENTION

A typical sump pump is founded on a sump pump liner or container that retains a sump pump. Sump pump liners of the prior art can, for instance, comprise cylindrical, plastic pails or barrels with the motorized sump pump therein. The liner normally holds the sump pump below the level of a floor in the basement of a home or other structure. When a predetermined water level is sensed by a water level switch, the sump pump is activated to pump the accumulated water out of the building structure or into a building's sewer drainage system.

Sump pump liners are often open at the top, but they may be covered to seal the unit against debris from entering the volume of the liner, to limit the escape of moisture and odor from the volume of the liner, and to prevent persons walking in the area of the pump from inadvertently stepping or falling into the liner. Prior art sump pump containers or liners are normally round such that they cannot conform to a right-angled corner of, for example, a foundation wall.

The present inventor has contributed to the art of active pumping and drainage systems with a plurality of patented and commercially successful advances beyond the prior art. By way of example, U.S. Pat. No. 6,619,001 taught Methods of Use of a Basement Water Drainage Conduit while an Appliance Surround Structure and Method of Installation were disclosed with U.S. Pat. No. 6,976,501. With U.S. Pat. No. 7,080,662, the inventor provided a Rain Recycling System. Further advances beyond prior art drainage systems were disclosed and protected by the present inventor with U.S. Pat. Nos. 7,503,725, 7,748,170, 7,832,150, 7,836,640, and 8,186,127. The disclosures of each of these patents is incorporated herein by reference.

Despite these many useful contributions to the art and those of multiple other capable inventors, the need remains for further improvement in the ability to engage and remove rain and groundwater accumulating in building structures. In this regard, the present inventor has recognized that active water removal systems and methods of the prior art are typically limited in their ability to engage, receive, and remove water. Sump pumps of the prior art typically occupy and operate over an extremely limited footprint and depth and must normally wait for accumulating water to reach the main body of the sump pump liner. While removing accumulating water quickly, efficiently, and completely is a long recognized need, previous sump pumps do not provide an active mechanism to attract water into the pumping volume.

SUMMARY OF THE INVENTION

With a knowledge of the current state of the art, the present inventor set forth with the basic object of providing a drainage system for building structures that actively engages, receives, and removes accumulated water thereby representing a notable advance in the art.

An underlying object of embodiments of the invention is to provide a drainage system that exhibits an effectively enlarged footprint to provide greater access to and removal of water.

Another object of embodiments of the invention is to provide a drainage system that attracts water into the pumping volume to permit the water to be rapidly engaged, received, and removed.

These and further objects, advantages, and details of the present invention will become obvious not only to one who reviews the present specification and drawings but also to those who have an opportunity to experience an embodiment of the drainage system disclosed herein in operation. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

The drainage system can be considered to be founded on a sump pump liner. While other shapes may be possible under the teachings provided herein, embodiments of the sump pump liner can have a rectangular, box-like configuration with top, a bottom, and four sidewalls. At least two of the sides could be disposed at right angles to one another. With that, the sump pump liner can fit conformingly into a corner of a basement having two foundation walls disposed at right angles to one another without substantial gaps around the sides disposed against the foundation wall to closely fit thereagainst. A plurality of drain apertures can be disposed in the sidewalls of the liner to allow accumulating drainage water to pass into the main open inner volume of the sump pump liner.

The sump pump liner can further include knockout plugs disposed in the sidewalls. The plugs can be knocked out to create an aperture that would permit, for example, a drain pipe to pass therethrough without the need for having the drain pipe extend through the lid of the sump pump liner. So disposed, the drain pipe can be disposed below the level of a poured concrete floor. In certain embodiments, the drain pipe can extend behind or in front of a foundation wall for removal of drainage water. The lid of the sump pump liner could be formed by two substantially rectangular-shaped doors. The doors could have interengaging lips which can be fastened, such as by mechanical fasteners, to the top of the sump pump liner. Access to the sump pump can be easily obtained by unfastening and removing one or both doors of the lid. Vents in the lid could be provided.

An electrical wire providing power to the sump pump or pumps can be extended to the sump pump liner, such as through a pipe disposed under adjacent flooring to an aperture formed by knocking out one of the knock-out plugs in one of the sidewalls of the liner. A rubber fitting can seal the pipe to the liner to help prevent odors and insects from escaping from below the floor. The pipe can extend at an angle to the surface of the floor next to the wall so that the wire does not need to occupy floor space.

A raised platform within the sump pump liner provides support for a first sump pump. It is desirable to have the sump pump raised above the bottom of the liner to prevent dirt, stones, and debris from getting into the impellers of the sump pump. An optional second stand or shelf member spaced from the bottom of the sump pump liner can be provided to support a second sump pump at a height higher than the height of the platform supporting the first sump pump. By way of example and not limitation, the shelf member can be disposed approximately 3 inches (7.5 cm) above the bottom of the sump pump liner, and a second sump pump can be positioned on the shelf member. Having one pump disposed at a height above the height of the other allows water to be pumped even if such water level gets higher than the height of the water that the lower pump is able to handle.

Embodiments of the drainage system can include further aspects that seek actively to engage, receive, and remove accumulated water to provide dryer basements and to reduce the negative effects of undesirable accumulations of water. For instance, the developed drainage system can exhibit an effectively enlarged footprint by the incorporation of one or more elongate lateral or longitudinal water harvesting arms with inner volumes in fluidic communication with the environment and the main inner volume of the sump pump liner. With that, deeper and wider access to and removal of water can be achieved. It is further contemplated that one or more low pressure void compartments can be disposed in direct communication with the open inner volume of the sump pump liner to attract water into the pumping volume defined by the liner to permit the water to be rapidly engaged, received, and removed.

As taught herein, a drainage system for engaging and removing accumulating drainage water can have a sump pump liner with a main body with an inner volume defined at least in part by at least one sidewall and a bottom. A sump pump can be disposed within the inner volume of the main body of the sump pump liner, and at least one contiguous or low pressure void with an inner volume can be disposed in fluidic communication with the inner volume of the sump pump liner.

In certain embodiments, the at least one contiguous void can be a low pressure void compartment disposed distal to the bottom of the main body of the sump pump liner. With that, when the sump pump liner is disposed in an upright orientation with the sidewalls disposed generally vertically in a volume of surrounding matter, the contiguous void compartment will be disposed below the inner volume of the main body of the sump pump liner and deeper into the volume of surrounding matter. In such constructions, the bottom of the sump pump liner can form a boundary between the inner volume of the main body of the sump pump liner and the contiguous void compartment, and a plurality of liner-void apertures can be disposed in the bottom of the main body of the sump pump liner.

It is further disclosed that the contiguous void compartment can be bounded distally by a void bottom partition with the void bottom partition retained in a plane generally parallel to a plane in which the bottom of the main body of the sump pump liner is disposed. A plurality of void-environment apertures can be disposed in the void bottom partition. In certain embodiments, the void bottom partition can be retained in spaced relation from the bottom of the main body of the sump pump liner by a plurality of legs. The legs could, for instance, comprise corner legs with lateral cross-sectional shapes that define an alcove within each corner leg. Where a plurality of void-environment apertures are disposed in the void bottom partition, one or more of the void-environment apertures can be disposed in the alcove of one or more of the corner legs. Within the scope of the invention, the contiguous void compartment could have open sides between the plurality of legs, or the contiguous void compartment could have sidewalls with a plurality of void-environment apertures.

It is further disclosed herein that the at least one low pressure, contiguous void can take the form of at least one water harvesting arm with a proximal end retained by the main body of the sump pump liner and a body portion that projects from the main body of the sump pump liner. For instance, the at least one water harvesting arm could be a lateral water harvesting arm that projects laterally from the at least one sidewall of the main body of the sump pump liner. Indeed, there can be plural lateral water harvesting arms that project laterally from the at least one sidewall of the main body. Where the main body has a rectangular cross section with four sidewalls, a lateral water harvesting arm could project from each sidewall. In other embodiments, the at least one water harvesting arm could comprise a longitudinal water harvesting arm that projects substantially longitudinally from the main body of the sump pump liner.

In either case, a plurality of arm-environment apertures can be disposed in the body portion of the lateral or longitudinal water harvesting arm. The size and shape of the water harvesting arm could vary within the scope of the invention. For example, the water harvesting arm can be substantially round in cross section. In other embodiments, the water harvesting arm could, for instance, be rectangular in cross section.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The drainage system with one or more contiguous voids disclosed herein is subject to varied embodiments, each within the scope of the invention. However, to ensure that one skilled in the art will be able to understand and, in appropriate cases, practice the present invention, certain preferred embodiments of the broader invention revealed herein are described below.

Figure 1:
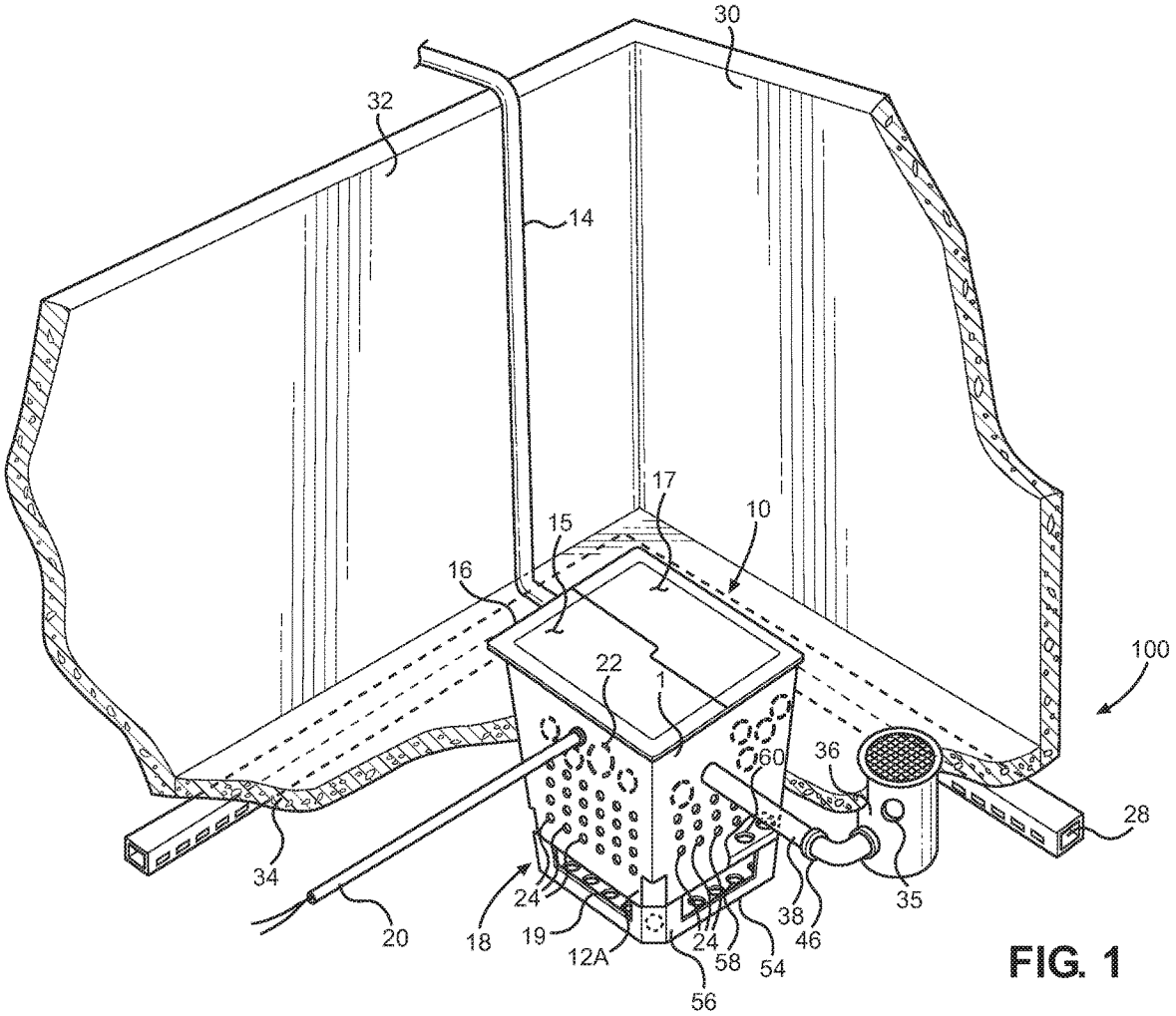
FIG. 1 is a perspective view of a drainage system with a contiguous void according to the present invention disposed in a poured concrete floor adjacent to the corner junction of adjoining foundation walls.
Figure 2:
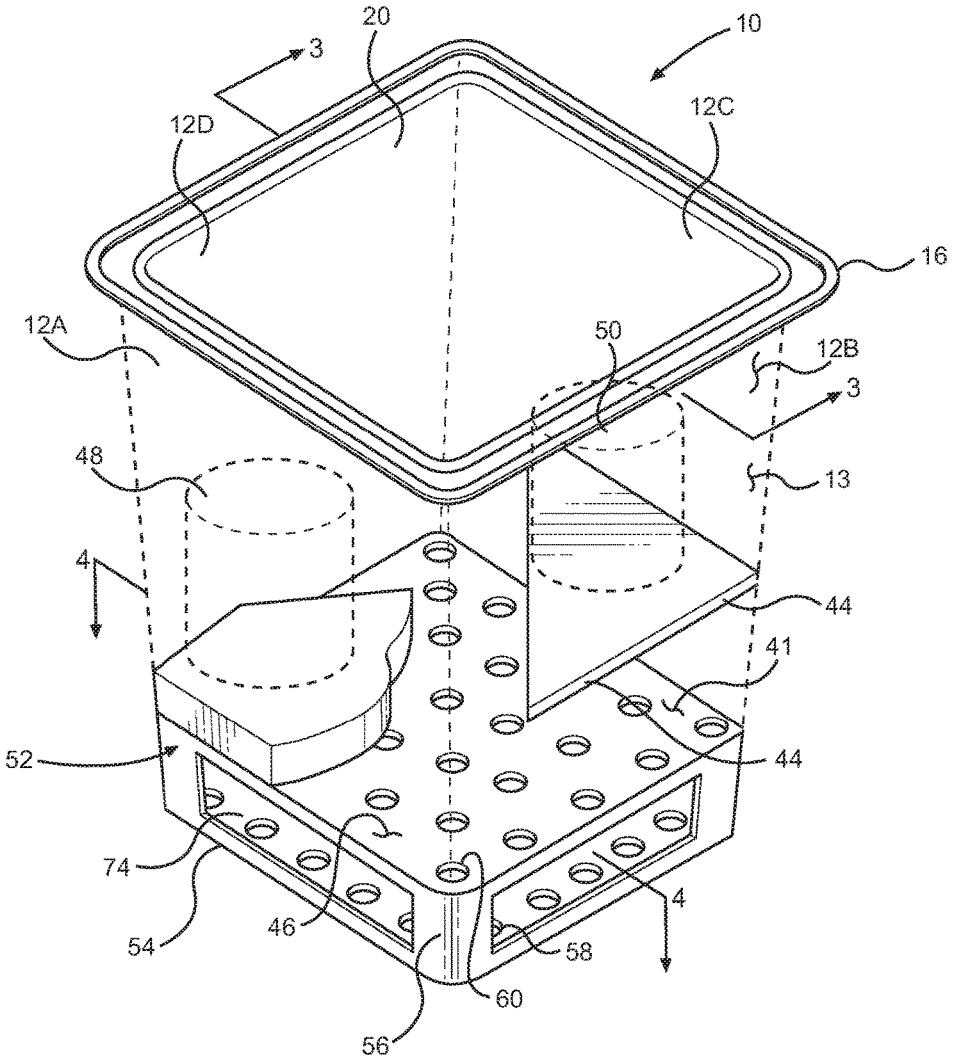
FIG. 2 is a perspective view of the sump pump liner of the drainage system of FIG. 1 with its side walls shown as transparent and with its lid removed.

A drainage system embodying the present invention is indicated generally at 100 in FIG. 1. There, the drainage system 100 can be considered to be founded on a sump pump liner 10. As FIG. 2, shows, the sump pump liner 10 has four outer walls 12A through 12D and a bottom 46 that together define a rectangular, box-like configuration. A peripheral rim 16 traverses the outer boundary defined by the upper ends of the walls 12A through 12D as can be perceived with further reference to FIG. 1. The sump pump liner 10 could, by way of example and not limitation, taper from an upper portion to a lower portion thereof, or the sump pump liner 10 could be of consistent lateral dimension. A lid, which in this embodiment is formed by first and second doors 15 and 17, selectively caps the open inner volume defined by the walls 12A through 12D and the bottom 46. The lid formed by the first and second doors 15 and 17 can, in certain embodiments, be free of apertures therein.

Typically, the sump pump liner 10 will be disposed below floor level in the basement of a building structure. For instance, as shown in FIG. 1, the sump pump liner 10 is disposed with its main body formed by the walls 12A through 12D below the level of a poured concrete floor 34 of a basement. With the adjacent sides 12A through 12D of the sump pump liner 10 being disposed at substantially right angles to one another, the sump pump liner 10 advantageously can be positioned immediately against a corner structure, such as a right-angled corner formed by a first foundation wall 30 and a second foundation wall 32.

As FIG. 1 further depicts, the sump pump liner 10 can further include a plurality of knockout plugs 22, which can be perforated or otherwise configured to permit selective removal thereof. The knockout plugs 22 can be disposed in one or more of the walls 12A through 12D. With this, knockout plugs 22 can be selectively removed. When a given plug 22 is removed, a hole is then defined in the respective wall 12A through 12D. The hole can be employed to receive a conduit 38, such as a hose or a drain pipe 38. The conduit 38 could extend through the hole or be attached thereto.

As best seen in FIGS. 1 and 2, plural wall apertures 24 are spaced over each of the sidewalls 12A through 12D. The apertures 24 could be spaced in a pattern and could traverse across and longitudinally along the sidewalls 12A through 12D. The apertures 24 permit groundwater to pass therethrough from the surrounding volume of earth and into the open inner volume of the sump pump liner 10.

In certain practices of the invention, the sump pump liner 10 can be fluidically coupled to a drain 36 to receive water therefrom. In FIG. 1, for example, the drain 36 is disposed in proximity to the sump pump liner 10. The drain 36 could be countersunk, such as by approximately ½ inch in the concrete floor 34. So disposed, the drain 36 will tend to receive water from in-house sources, such as deriving from foundation wall seepage, incoming rainwater, or water released due to an accident, such as the rupture of a water pipe. The drain 36 can incorporate a one-way valve 35 to prevent, by way of example and not limitation, gasses, such as radon, from entering the basement through the drain 36 while permitting water drainage through the drain pipe 38. The one-way valve 35 could, for instance, comprise a buoyant ball or other buoyant object disposed above the opening of drain pipe 38.

The rectangular footprint of the sump pump liner 10 allows it to be set extremely close to, for example, adjoining foundation walls 30 and 32 where a round liner (not shown) would permit only a portion or portions of the liner to be disposed near a wall 30 or 32 or a junction between walls 30 and 32 with the arcuate adjacent portions necessarily being spaced from the wall or walls 30 and 32. The sump pump liner 10 of the present invention, could, for instance, be disposed on a foundation footing extremely close to the adjoining foundation walls 30 and 32.

In some embodiments, a drainage pipe 28 having apertures defined therein can be placed around the perimeter of the basement, such as within or under concrete floor 34, to receive water and direct it to the sump pump liner 10, such as through a pipe and, additionally or alternatively, the drain 36. Since the sides of the sump pump liner 10 are angled, the top of the liner 10 can still be near the basement walls 30 and 32 even where there is room to position drainage pipe 28 around the sump at a point under the thickness of the floor.

A discharge pipe 14 is fluidically coupled to receive water from a pump 48 or plural pumps 48 and 50 within the open inner volume of the sump pump liner 10. The discharge pipe 14 can, for instance, exit the liner 10 through an aperture formed by the removal of a knocked out plug 22 in a sidewall 12A of the liner 10. The discharge pipe 14 can facilitate the removal of the pumped water from the basement, such as by leading to the exterior of the building structure or by passing the water into the building's sewer line. In the depicted embodiment, the discharge pipe 14 continues under the floor 34 and extends up or behind basement wall 32 then to exit the basement.

Where the lid of the sump pump liner 10 is substantially continuous, such as by being formed by first and second doors 15 and 17 without apertures or pipes therethrough, carpet or flooring can be applied over the doors 15 and 17 of the lid and the rim 16 of the sump pump liner 10. Doing so permits a better appearance and a safer installation compared to the installation of prior art sumps, which typically either remain uncovered or have pipes extending therefrom.

As seen in the partially transparent view of FIG. 2, a raised platform 52 can be disposed atop the bottom 46 of the sump pump liner 10. Without limitation, the platform 52 could, for instance, be disposed at a height of approximately 1.5 inches above the bottom 46 of the liner 10 to support a first sump pump 48. The platform can assist in preventing stones, dirt, silt and other debris from passing through the impellers of the pump 48.

Embodiments of the drainage system 100 are contemplated with a second pump 50 disposed within the open inner volume of the sump pump liner 10. The second pump 50 can, for instance, be supported at a different height than the height at which the first pump 48 is supported. For example, a stand 42 could be disposed within the open inner volume of the sump pump liner 10 and spaced from the bottom 46 thereof, such as by a height of approximately 3 to 6 inches above bottom 46 of the liner 10. The stand 42 could be supported in any effective manner, including, for instance, integral formation, adhesive, mechanical fasteners, or in some other manner. In the present embodiment, the stand 42 is retained by slots 44 disposed in sidewalls 12B and 12C that receive and retain the edges of the stand 42. In certain embodiments, the stand 42 can be in the form of a shelf member having first and second right-angled sides that engage and are retained by the slots 44 to support the second sump pump 50. The second pump 50 could be actuated simultaneously with the first pump 48, as a backup, or in some other manner.

The drainage system 100 described above is effective and advantageous as compared to those of the known prior art. Nonetheless and particularly in view of the damage to building structures and the health risks posed by undesired water accumulations in buildings, there remains a demonstrable need in the art for a drainage system that provides for greater access to surrounding volumes of earth and retained water and that provides enhanced attraction and removal of water, particularly in the vicinity of the sump pump liner 10. The present inventor has thus devised of further aspects of the drainage system 100 that seek actively to engage, receive, and remove accumulated water thereby providing for dryer basements and reduced or eliminated deleterious effects of undesirable accumulations of water. In certain embodiments and aspects, the developed drainage system 100 exhibits an effectively enlarged footprint thereby to provide greater access to and removal of water. Moreover, with one or more low pressure voids in direct communication with the open inner volume of the sump pump liner 10, drainage systems 100 as taught herein attracts water into the pumping volume defined by the liner 10 to permit the water to be rapidly engaged, received, and removed.

Looking again to FIG. 1, sump pump liners 10 of drainage systems 100 according to the present invention can include a contiguous or low pressure void compartment 18 with an inner volume 19 in contiguous fluidic communication with the main open inner volume 20 of the sump pump liner 10 defined by the sidewall or sidewalls 12A through 12D, the bottom 46, and, where applied, the lid formed by the first and second doors 15 and 17. In the depicted embodiment, the contiguous void compartment 18 is disposed distal to the bottom 46 of the main body of the sump pump liner 10 such that, when the sump pump liner 10 is disposed in an upright orientation with the sidewalls 12A through 12D disposed generally vertically in a volume of earth or other surrounding matter, the contiguous void compartment 18 will be disposed below the main open inner volume 20 of the sump pump liner 10 and deeper into the volume of surrounding matter. The bottom 46 of the main open inner volume 20 thus serves as a boundary between the main volume 20 of the sump pump liner 10 and the inner volume 19 of the void compartment 18. The main volume 20 is in fluidic communication with the inner volume 19 of the void compartment 18 by virtue of a plurality of liner-void apertures 60 disposed in the bottom 46 of the main body of the sump pump liner 10.

Figure 4:
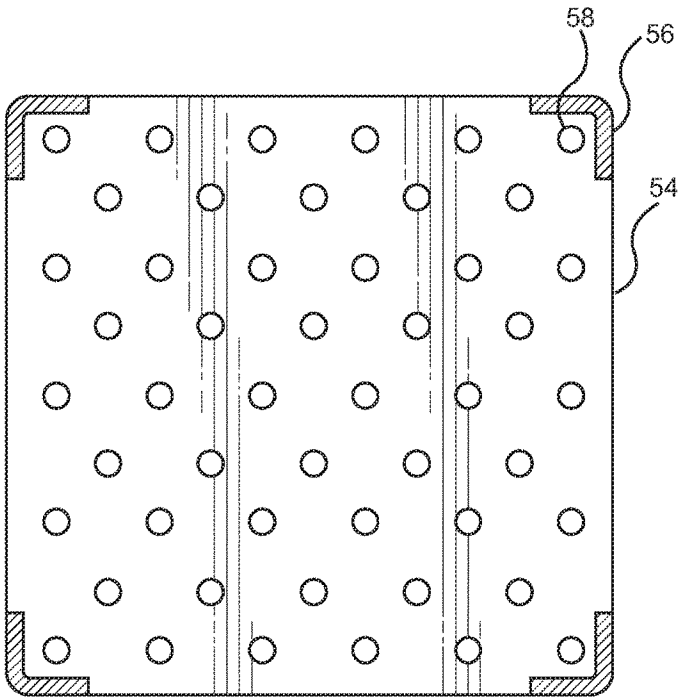
FIG. 4 is a lateral cross-sectional view of the sump pump liner taken along the line 4-4 in FIG. 2.
Figure 3:
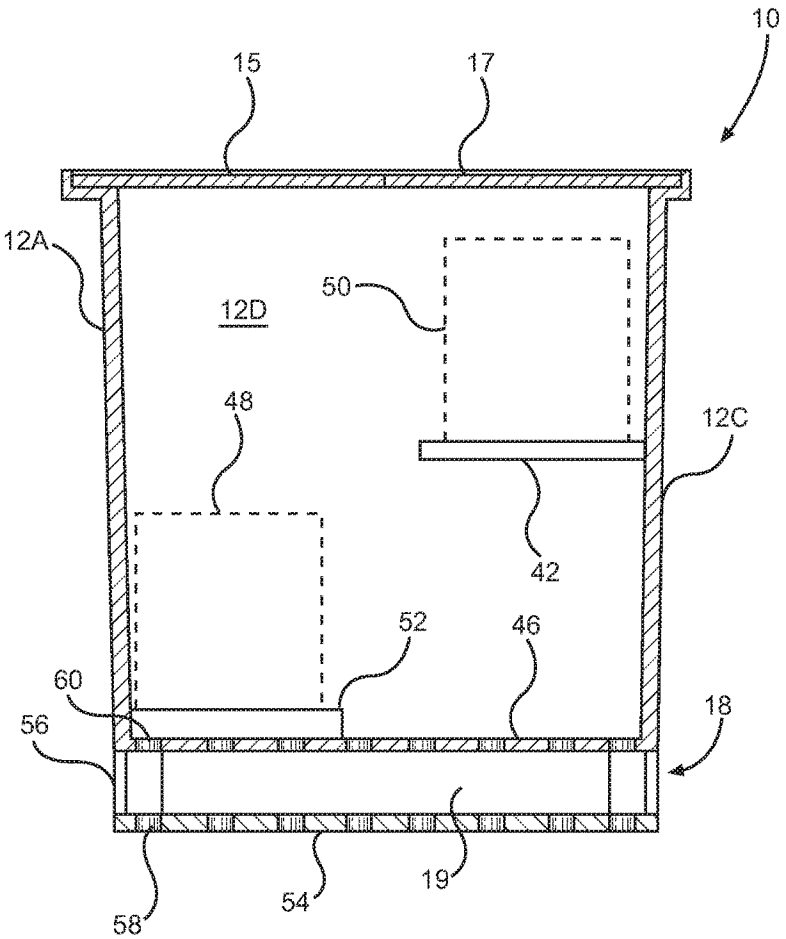
FIG. 3 is a longitudinal cross-sectional view of the sump pump liner of FIG. 2 taken along the line 3-3 in FIG. 2.

In the present embodiment, the contiguous void compartment 18 is bounded distally by a void bottom partition 54 that serves to space the bottom 46 of the main open inner volume 20 from surrounding matter with the inner volume 19 therebetween. The void bottom partition 54 is, in this example, retained in a plane generally parallel to a plane in which the bottom 46 of the main body of the sump pump liner 10 is disposed. While the dimensions of the sump pump liner 10 and the void compartment 18 can vary, one embodiment of the invention contemplates a void compartment 18 of approximately 4 inches (10 cm). In this embodiment, the void bottom partition 54 is retained relative to the main body of the sump pump liner 10 by a plurality of legs 56, which in this manifestation comprise corner legs 56. The corner legs 56 here have L-shaped lateral cross-sectional shapes as can be best seen perhaps in FIGS. 3 and 4. With that, each leg 56 defines an alcove between the generally perpendicularly disposed segments of the L-shape.

The void compartment 18 has open sides between the corner legs 56 to permit fluidic communication laterally with matter surrounding the sump pump liner 10. The open sides could be shielded by a wire mesh (not shown) or other material with interstitial openings. The void bottom partition 54 has a plurality of spaced void-environment apertures 58 therethrough that permit fluidic communication longitudinally between the void compartment 18 and matter surrounding the sump pump liner 10. As is illustrated, one or more of the liner-void apertures 60 and, additionally or alternatively, the void-environment apertures 58 can be disposed in the alcove defined by one or more of the L-shaped corner legs 56. With that, clogging of those apertures 58 and 60 by environmental matter can be minimized.

The pump or pumps 48 and 50 are thus retained at a given height within the main open inner volume 20 and vertically spaced and insulated from environmental matter by the additional inner volume 19 of the void compartment 18 while the sump pump liner 10 and the overall drainage system 10 has a deeper effective reach for permitting entry of and access to accumulating water. Moreover, the open volume of the void compartment 18 increases exposure to environmental water accumulations and is designed to effect what can be characterized as a severe attraction of surrounding water to permit the removal thereof by active pumping.

Figure 5:
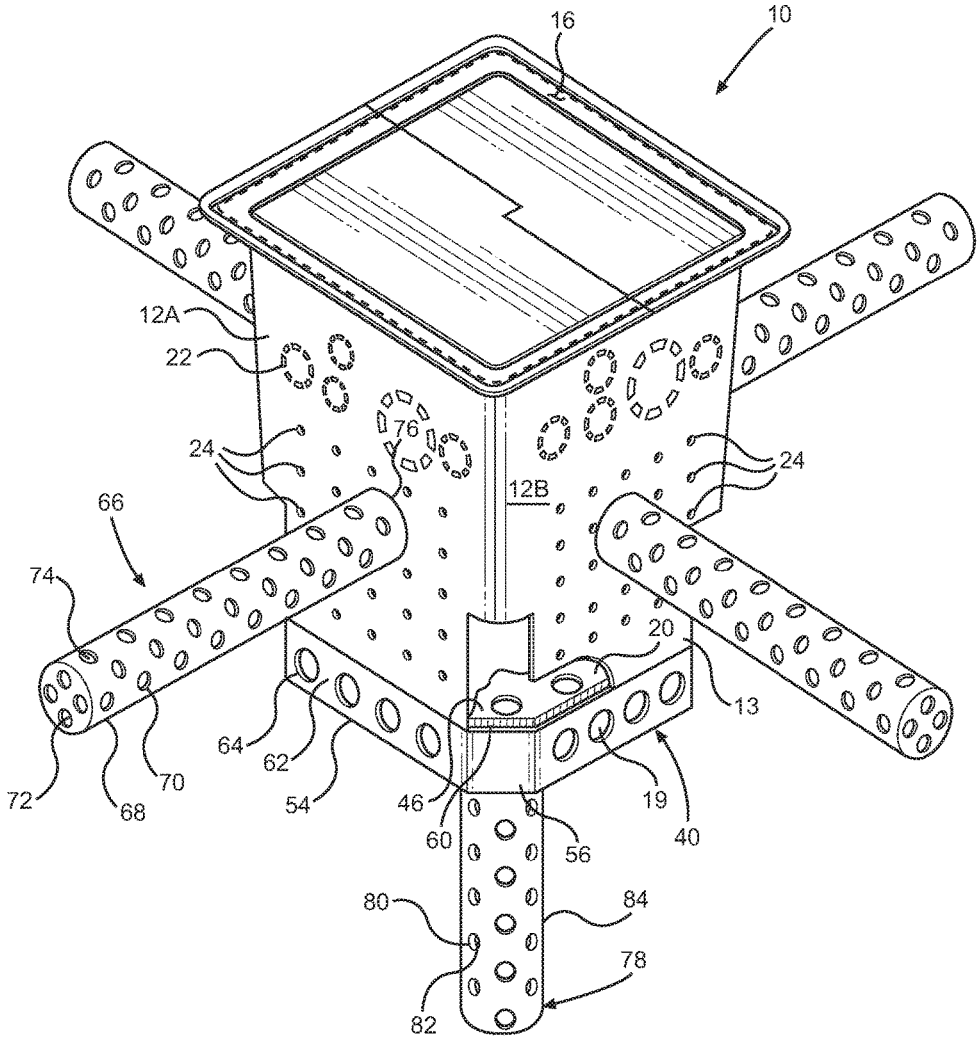
FIG. 5 is a perspective view of an alternative sump pump liner embodying the present invention with plural contiguous voids.

Other manifestations of the void compartment 18 are possible and within the scope of the invention. One alternative embodiment is shown in FIG. 5. There, the void compartment 18 again has a void bottom partition 54 retained in a plane generally parallel to the bottom 46 of the sump pump liner 10 by a plurality of corner legs 56. Here, however, the corner legs 46 are disposed on diagonals to the corners between the sidewalls 12A through 12D, and the corner legs 46 are connected by void compartment sidewalls 62. Each of the void compartment sidewalls 62 has a plurality of void-environment apertures 64 therein to establish fluidic communication laterally between the void compartment 18 and matter surrounding the sump pump liner 10. Although not visible in FIG. 5, the void bottom partition 54 can again have void-environment apertures spaced thereover for providing fluidic communication longitudinally or vertically between the void compartment 18 and matter surrounding the sump pump liner 10.

In the embodiment of FIG. 5, access to and attraction of water within a surrounding volume of material is further increased by a plurality of lateral or horizontal water harvesting arms 66 that project laterally from the main body of the sump pump liner 10. Here, there are four lateral water harvesting arms 66, one projecting from each of the four sidewalls 12A through 12D.

Each water harvesting arm 66 has an elongate sleeve portion 68. The sleeve portion 68 can be rigid, such as by being formed from a rigid plastic or a metal. Each water harvesting arm 66 has an inner volume 74 and a proximal end in contiguous fluidic communication with the open inner volume 20 of the main body of the sump pump liner 10, such as by being entirely open thereto. For example, the water harvesting arms 66 could be received and retained relative to an aperture formed by removing a knockout plug 22, or dedicated apertures 76 could be provided in the sidewalls 12A through 12D of the sump pump liner 10. The water harvesting arms 66 could be formed integrally with or otherwise fastened to the sidewalls 12A through 12D. The arms 66 could vary in length and cross sectional shape and dimension. In one presently contemplated embodiment, the arms 66 are tubular with a length of roughly 12 inches (31 cm).

Each arm 66 has a plurality of lateral arm-environment apertures 70 spaced along the sleeve 68 and a plurality of longitudinal arm-environment apertures 72 disposed in the distal end of the sleeve 68. With that, the inner volumes 74 of the arms 66 and, derivatively, the main inner volume 20 of the sump pump liner 10 are in fluidic communication with surrounding volumes of earth or other matter. With the pumping effect provided by the pump or pumps 48 and 50, the water harvesting arms 66 thus operate to provide access to and attraction of surrounding volumes of accumulating water. The sump pump liner 10 thus is able to operate to harvest and remove water over a greater effective footprint as the effective reach of the pump or pumps 48 and 50 is increased. Rather than any pressure differential induced by the pump or pumps 48 and 50 being localized to the main body defined by the four sidewalls 12A through 12B, the reach of the pumps 48 and 50 is expanded over the lengths and widths of the several water harvesting arms 66 and potentially a volume of matter immediately surrounding the same.

Still further, as is also shown in FIG. 5, the sump pump liner 10 can have increased access to and attraction of water within a surrounding volume of material below the liner 10 by the inclusion of one or more contiguous voids comprising longitudinal or vertical water harvesting arms 78. In the liner 10 of FIG. 5, there is one longitudinal water harvesting arm 78. The longitudinal water harvesting arm 78 in FIG. 5 projects distally from the bottom 46 of the liner 10 through the low pressure void compartment 18. When the sump pump liner 10 is installed in a vertical orientation in, for instance, the floor of a basement, the longitudinal water harvesting arm 78 will thus project vertically downward deeper into the ground beyond the bottom 46 and the low pressure void compartment 18.

The longitudinal water harvesting arm 78 has an elongate sleeve portion 84. Again, the sleeve portion 68 can be rigid, such as by being formed from a rigid plastic or a metal. The longitudinal water harvesting arm 78 has an inner volume 82 and a proximal end in contiguous fluidic communication with the open inner volume 20 of the main body of the sump pump liner 10, such as by being entirely open thereto. The water harvesting arm 78 could be received and retained relative to an aperture formed in the bottom 46 of the sump pump liner 10. It would also be possible for the water harvesting arm 78 to be formed integrally with or otherwise fastened to the bottom 46. The arm 78 could vary in length and cross sectional shape and dimension. In one presently contemplated embodiment, the arm 78 can be tubular with a length of roughly 12 inches (31 cm).

The arm 78 has a plurality of lateral arm-environment apertures 80 spaced along the sleeve 84 and a plurality of longitudinal arm-environment apertures (not shown) disposed in the distal end of the sleeve 78. The inner volume 82 of the arm 78 and, through the arm 78, the main inner volume 20 of the sump pump liner 10 are thus in enhanced fluidic communication with volumes of earth or other matter below the liner 10. The water harvesting arm 78 thus operates to provide access to and attraction of surrounding volumes of accumulating water through the pumping effect provided by the pump or pumps 48 and 50. The sump pump liner 10 can then harvest and remove water over a deeper effective volume as the effective reach of the pump or pumps 48 and 50 is increased. Any pressure differential induced by the pump or pumps 48 is deepened over the length and width of the longitudinal water harvesting arm 78 and potentially a volume of matter immediately surrounding the same.

It will be noted, however, that the concept of one or more contiguous or low pressure voids should not be interpreted as requiring a pressure differential to occur, and it should not be interpreted as representing or suggesting that such a pressure differential will necessarily exist. Moreover, the term void as used herein should not be interpreted as requiring emptiness except as the claims may expressly specify.

Figure 6:
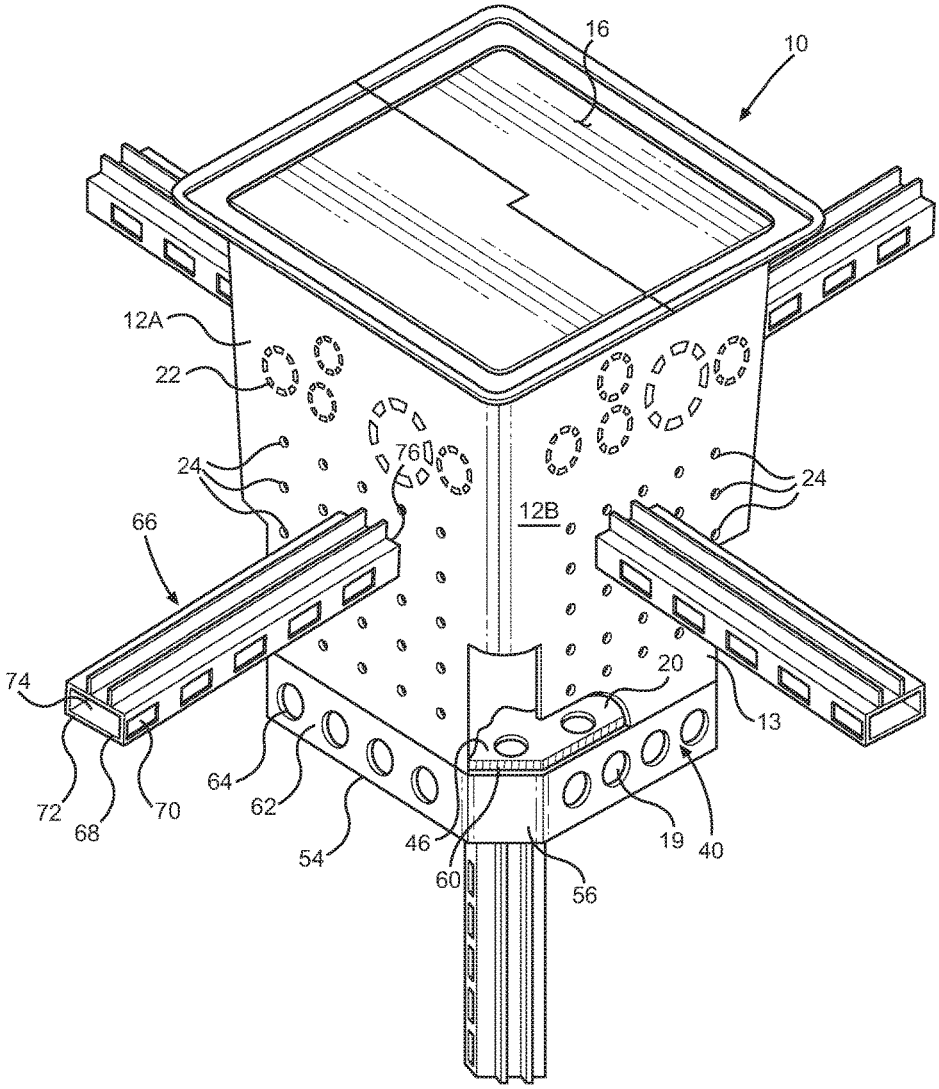
FIG. 6 is a perspective view of another sump pump liner embodying the invention with plural contiguous voids.

Other embodiments of the sump pump liner 10 with one or more lateral water harvesting arms 66 and, additionally or alternatively, longitudinal water harvesting arms 78 are contemplated and within the scope of the invention. By way of example and not limitation, the arms 66 and 78 could alternatively be constructed as in FIG. 6. There, the arms 66 and 78 are as disclosed in the present inventor's U.S. Pat. No. 6,619,001 for a Method of Use of a Basement Water Drainage Conduit, which again is incorporated herein by reference. The arms 66 and 78 are formed from sleeves 68 and 84 of conduit with an elongate structure of rectangular cross section. A plurality of elongate apertures 70 and 80 are spaced along each of the sidewalls of the sleeves 68 and 84. A pair of rigidifying engagement members extend upward from the top wall of the sleeves 68 and 84. The inner volumes 74 of the arms 66, derivatively, the main inner volume 20 of the sump pump liner 10 are in fluidic communication with surrounding volumes of earth or other matter.

Access to and attraction of water within a surrounding volume of material is thus again increased by the lateral water harvesting arms 66. The sump pump liner 10 thus is able to operate to harvest and remove water over a greater effective footprint, and the effective reach of the pump or pumps 48 and 50 is increased. Moreover, with the longitudinal water harvesting arm 78 projecting distally from the bottom 46 of the liner 10 through the low pressure void compartment 18, the sump pump liner 10 can harvest and remove water over a deeper effective volume as the effective reach of the pump or pumps 48 and 50 is increased.

With certain details and embodiments of the present invention for a drainage system 100 with one or more contiguous voids disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. A drainage system for engaging and removing accumulating drainage water, the drainage system comprising:

a sump pump liner with a main body with an inner volume defined at least in part by at least one sidewall and a bottom;

a sump pump disposed within the inner volume of the main body of the sump pump liner;

at least one contiguous void with an inner volume in fluidic communication with the inner volume of the sump pump liner wherein the at least one contiguous void comprises a contiguous void compartment disposed distal to the bottom of the main body of the sump pump liner whereby, when the sump pump liner is disposed in an upright orientation with the at least one sidewall disposed generally vertically in a volume of surrounding matter, the contiguous void compartment will be disposed below the inner volume of the main body of the sump pump liner and deeper into the volume of surrounding matter, wherein the bottom of the main body of the sump pump liner comprises a boundary between the inner volume of the main body of the sump pump liner and the contiguous void compartment, wherein the contiguous void compartment is bounded distally by a void bottom partition, and wherein the void bottom partition is retained in spaced relation from the bottom of the main body of the sump pump liner by a plurality of legs; and a plurality of liner-void apertures disposed in the bottom of the main body of the sump pump liner.

2. The drainage system of claim 1 wherein the void bottom partition is retained in a plane generally parallel to a plane in which the bottom of the main body of the sump pump liner is disposed.

3. The drainage system of claim 2 further comprising a plurality of void-environment apertures disposed in the void bottom partition.

4. The drainage system of claim 1 wherein the plurality of legs comprise corner legs with lateral cross-sectional shapes that define an alcove within each corner leg.

5. The drainage system of claim 4 further comprising a plurality of void-environment apertures disposed in the void bottom partition wherein one or more of the void-environment apertures are disposed in the alcove of one or more of the corner legs.

6. The drainage system of claim 1 wherein the contiguous void compartment has open sides between the plurality of legs.

7. The drainage system of claim 6 wherein the contiguous void compartment has sidewalls with a plurality of void-environment apertures therein.

8. The drainage system of claim 1 wherein the at least one contiguous void further comprises at least one water harvesting arm with a proximal end retained by the main body of the sump pump liner and a body portion that projects from the main body of the sump pump liner.

9. The drainage system of claim 8 wherein the at least one water harvesting arm comprises a lateral water harvesting arm that projects laterally from the at least one sidewall of the main body of the sump pump liner.

10. The drainage system of claim 9 wherein there are plural lateral water harvesting arms that project laterally from the at least one sidewall of the main body.

11. The drainage system of claim 10 wherein the main body has a rectangular cross section with four sidewalls and wherein a lateral water harvesting arm projects from each sidewall.

12. The drainage system of claim 8 wherein the at least one water harvesting arm comprises a longitudinal water harvesting arm that projects substantially longitudinally from the main body of the sump pump liner.

13. The drainage system of claim 8 wherein a plurality of arm-environment apertures are disposed in the body portion of the water harvesting arm.

14. The drainage system of claim 13 wherein the water harvesting arm is substantially round in cross section.

15. The drainage system of claim 13 wherein the water harvesting arm is rectangular in cross section.

16. A drainage system for engaging and removing accumulating drainage water, the drainage system comprising:

a sump pump liner with a main body with an inner volume defined at least in part by at least one sidewall and a bottom;

a sump pump disposed within the inner volume of the main body of the sump pump liner;

a contiguous void compartment with an inner volume in fluidic communication with the inner volume of the sump pump liner wherein the contiguous void compartment is disposed distal to the bottom of the main body of the sump pump liner whereby, when the sump pump liner is disposed in an upright orientation with the sidewalls disposed generally vertically in a volume of surrounding matter, the contiguous void compartment will be disposed below the inner volume of the main body of the sump pump liner and deeper into the volume of surrounding matter;

wherein the bottom of the sump pump liner comprises a boundary between the inner volume of the main body of the sump pump liner and the contiguous void compartment, wherein the contiguous void compartment is bounded distally by a void bottom partition, and wherein the void bottom partition is retained in a plane generally parallel to a plane in which the bottom of the main body of the sump pump liner is disposed and in spaced relation from the bottom of the main body of the sump pump liner by a plurality of legs; and a plurality of liner-void apertures disposed in the bottom of the main body of the sump pump liner.

* * * * *